US006782725B2

(12) United States Patent
Linares

(10) Patent No.: US 6,782,725 B2
(45) Date of Patent: Aug. 31, 2004

(54) PUSH BUTTON LOCK

(75) Inventor: Rodolfo Linares, Whittier, CA (US)

(73) Assignee: S.P.E.P. Acquisition Corporation, Rancho Dominguez, CA (US)

( * ) Notice: Subject to any disclaimer, the term of this patent is extended or adjusted under 35 U.S.C. 154(b) by 85 days.

(21) Appl. No.: 10/287,288

(22) Filed: Nov. 4, 2002

(65) Prior Publication Data

US 2004/0083781 A1 May 6, 2004

(51) Int. Cl.[7] ..... E05B 33/00

(52) U.S. Cl. ..... 70/360; 70/361; 70/386; 70/387; 70/DIG. 20; 70/DIG. 37; 292/252; 292/DIG. 37

(58) Field of Search ..... 70/360–361, 367–371, 70/386–387, 34, 100, 449, 451, 466, DIG. 20, DIG. 27, DIG. 36, DIG. 70; 292/32, 137, 252, DIG. 37, DIG. 61

(56) References Cited

U.S. PATENT DOCUMENTS 2,705,884 A 4/1955 Craig
2,728,214 A 12/1955 Craig (List continued on next page.)

FOREIGN PATENT DOCUMENTS

WO WO 9111579 A1 * 8/1991 ..... E05B/29/00

OTHER PUBLICATIONS

Attached are sheets of photographs of products offered by others, which were offered at least as early as Jul. 16, 2002, in the case of sheets 1 and 2, and Oct. 4, 2002, in the case of Sheet 3. Sheet 1 includes photographs of selected features of a truck bed mountable tool box offered by Knaack Mfg. Co. of Crystal Lakes, Illinois, which shows a design for a push button lock that operates differently than the push button lock claimed in the pending patent application. Sheet 2 includes photographs of selected features of a "Husky" brand truck bed mountable tool box offered with hardware, including a push button lock, provided by Eberhard Manufacturing Co., of Cleveland, Ohio. This push button lock does not appear on Eberhard's web site at www.eberhard-.com as of the date of this IDS submission. Sheet 3 includes a photograph of the Better Built brand truck bed mountable tool using a push button lock offered by Eberhard Munufacturing Co., of Cleveland, Ohio.

This push button lock does not appear on Eberhard's website at www.eberhard.com as of the date of this submission. This push button lock operates in a manner differently from the push button lock of the present invention.

*Primary Examiner*—Lynne H. Browne
*Assistant Examiner*—Christopher Boswell
(74) *Attorney, Agent, or Firm*—Christie, Parker & Hale, LLP

(57) ABSTRACT

A push button lock. The push button lock has a main housing with an aperture formed therethrough, a plunger which is axially moveable in the aperture of the main housing, and a ball retainer positioned in the aperture of the main housing. The ball retainer has a central aperture formed therein through which the plunger extends and a protrusion. Balls are placed on the ball retainer. An actuator is located in the main housing aperture above the ball retainer and is rotatable to an open position, wherein the actuator is in position to be pushed down to prevent the balls from moving away from the plunger shaft and thereby prevent the plunger shaft from moving relative to the ball retainer, and a locked position, wherein the balls are not retained against the plunger shaft and the plunger shaft can move relative to the balls retainer. A lock button having a lock housing and a lock cylinder is provided, with the lock cylinder being adapted to turn the actuator from the opened position to the locked position.

19 Claims, 12 Drawing Sheets

U.S. PATENT DOCUMENTS 2,772,908 A 12/1956 Craig
2,987,907 A 6/1961 Cockburn et al.
3,018,652 A * 1/1962 Dubonnet ..... 292/DIG. 37
3,602,017 A 8/1971 Bauer
4,488,669 A 12/1984 Waters
4,712,395 A * 12/1987 Agbay ..... 70/34
5,133,203 A * 7/1992 Huang ..... 70/360
5,308,126 A 5/1994 Weger, Jr. et al.
5,428,873 A * 7/1995 Hitchcock et al. ..... 70/386
5,447,049 A * 9/1995 Shieh ..... 70/360
5,689,980 A 11/1997 Weinerman et al.
5,916,279 A * 6/1999 Shieh ..... 70/33
D445,015 S 7/2001 Weinerman et al.
6,290,268 B1 9/2001 Cohen et al.
6,454,320 B1 9/2002 Weinerman et al.
6,463,774 B2 * 10/2002 Sokurenko ..... 70/360
6,619,078 B1 * 9/2003 Reese ..... 70/34
6,684,670 B1 * 2/2004 Agbay et al. ..... 70/34

* cited by examiner

PUSH BUTTON LOCK

BACKGROUND OF THE INVENTION

As concern about security rises, so too does the prevalence of lock use. While locks can help deter theft and vandalism, it is important to reduce the inconvenience of using locks to the greatest extent possible, so that the locks will be consistently used.

Many types of containers, including cabinets, boxes, and tool chests have movable closures (e.g. lids and doors). For added security, locking systems are used to prevent unauthorized opening of these containers. One important application of locks has been in their use in pickup truck bed boxes, which are placed between the sidewalls of the pickup's bed adjacent to the cab. Locking bed boxes have been around for many years, and comprise a container with at least one cover. Older designs used two covers accessible from right and left sides of the truck. In these older pickup truck bed boxes designs, separate key locks controlled access to the left and right sides of the box and there did not need to be any connection between the two. More recent designs for pickup truck bed boxes include a single cover which is hinged to the rear of the single box. Key locks are located either on the left and right side walls of the box (e.g. push button locks) or on the left and right front sides of the box (e.g. paddle locks), and these key locks operate at least one and more often two latches that are mounted inside the box. Push button locks are ideal because they can be easily accessed by a user standing at a left or right side of the truck, or standing in the back of the truck. These key locks are connected to the latches in such a manner that a user can open the cover from the left or right side of the box that has been unlocked. The latches are used to secure the lid to the box when the lid is closed. Rotary style latches, bayonet style latches and other types of latches can be used, with rotary style latches typically providing better tamper resistance than bayonet style latches. In order to be able to open pairs of existing rotary style and bayonet style latches by opening either a single push button lock or a single paddle lock, linking structures and mechanism must be provided. These linking structures and mechanism can comprise multiple activation rods and direction reversing mechanisms, all of which add to the parts and assembly costs.

There accordingly remains a need for push button locks that can be used in locking systems for containers that provide for maximized security yet has lower parts and assembly costs regardless of the precise storage container and closure the locking system is applied to.

SUMMARY OF THE INVENTION

The invention provides a push button lock that has a plunger which will retract into a main housing of the push button lock when the lock is in the locked position and also unlocked so long as the push button is not depressed.

The push button lock has several parts. A main housing with an aperture formed therethrough is provided. A plunger is axially moveable in the aperture of the main housing. A ball retainer is positioned in the main housing aperture and has a central aperture formed therein through which the plunger extends, and has a protrusion formed on the ball retainer. A plunger spring for biasing the plunger away from the ball retainer is provided, and at least one ball is placed on the ball retainer. An actuator is located in the main housing aperture above the ball retainer and is rotatable to retain the ball against the plunger shaft and prevent the plunger shaft from moving relative to the ball retainer when in an opened position, and in a locked position, wherein the moveable stopper is not retained against the plunger shaft and the plunger shaft can move relative to the ball retainer. The push button lock button has a lock housing and a lock cylinder, with the lock cylinder being adapted to turn the actuator from the opened position to the locked position. A ball retainer spring for biasing the moveable stopper retainer towards the lock button is provided and an actuator spring for biasing the actuator away from the moveable stopper retainer is also provided so that unless lock button is depressed in the unlocked or locked position, the plunger will be capable of being pushed into the main housing.

DETAILED DESCRIPTION OF THE INVENTION

Figure 1:
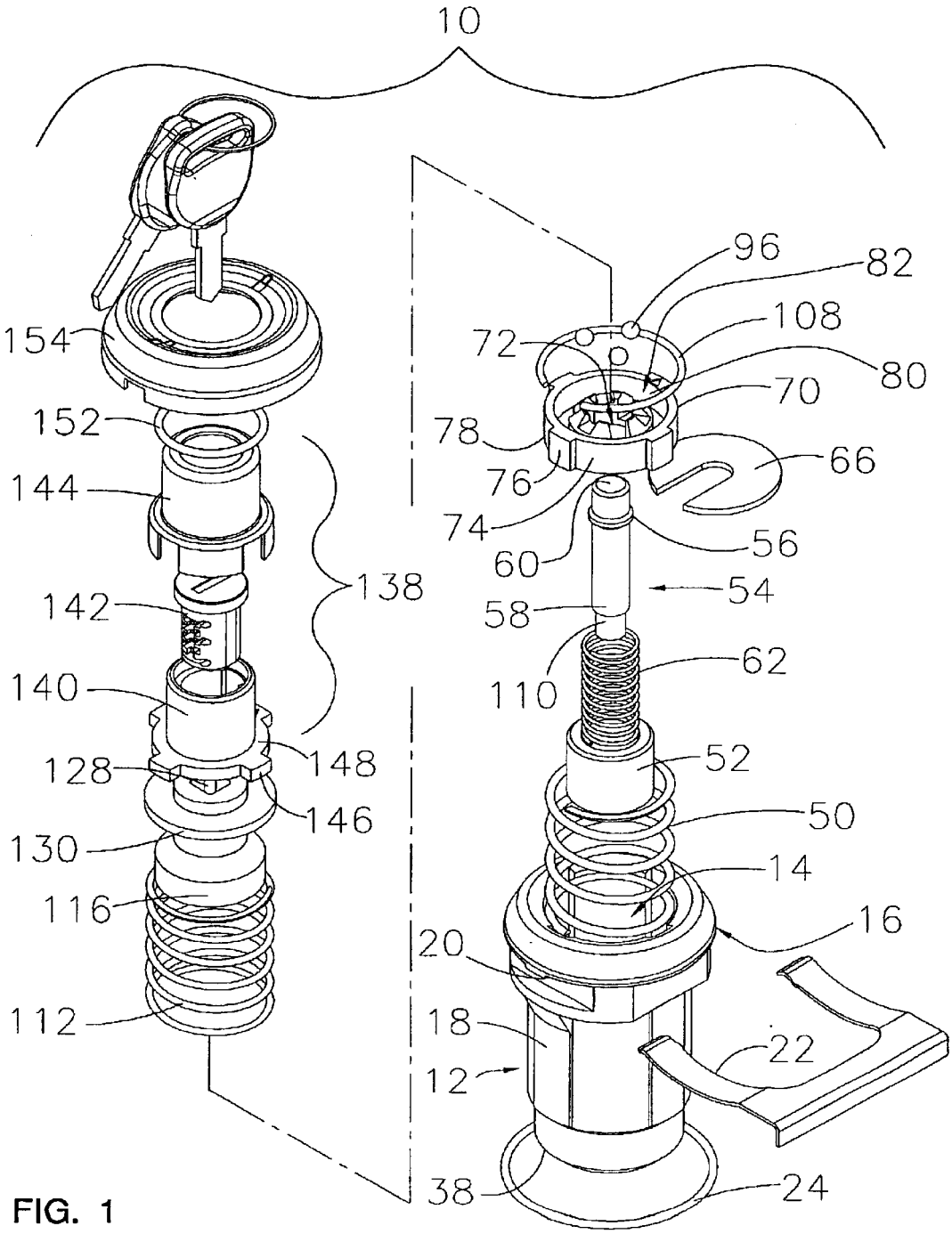
FIG. 1 is an exploded view of a push button lock of the invention.

Turning to FIG. 1, there is shown an exploded view of a push button lock 10 of the invention. Push button lock 10 has the following main components. A main housing 12 is provided with an aperture 14 formed therein. Housing 12 has an enlarged seating end 16 which seats on an exterior surface of a container (not shown), a sleeve portion 18 that is adapted to be retained within an aperture (not shown) in a container or wall, and a clip engagement portion 20 (such as a slot in sleeve), which is adapted to receive a clip 22 or other retainer for retaining main housing 12 within the aperture in the container. A washer, such as an O-ring 24 can be provided for sealing against seating end 16.

Figure 2:
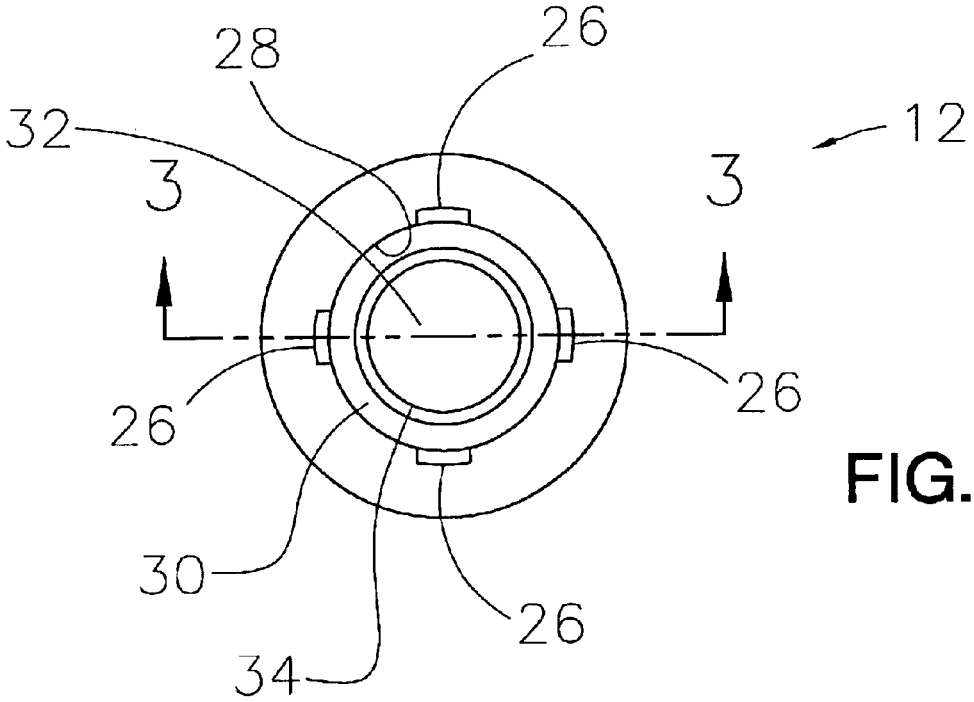
FIG. 2 is a top view of the housing for the push button lock of FIG. 1.
Figure 3:
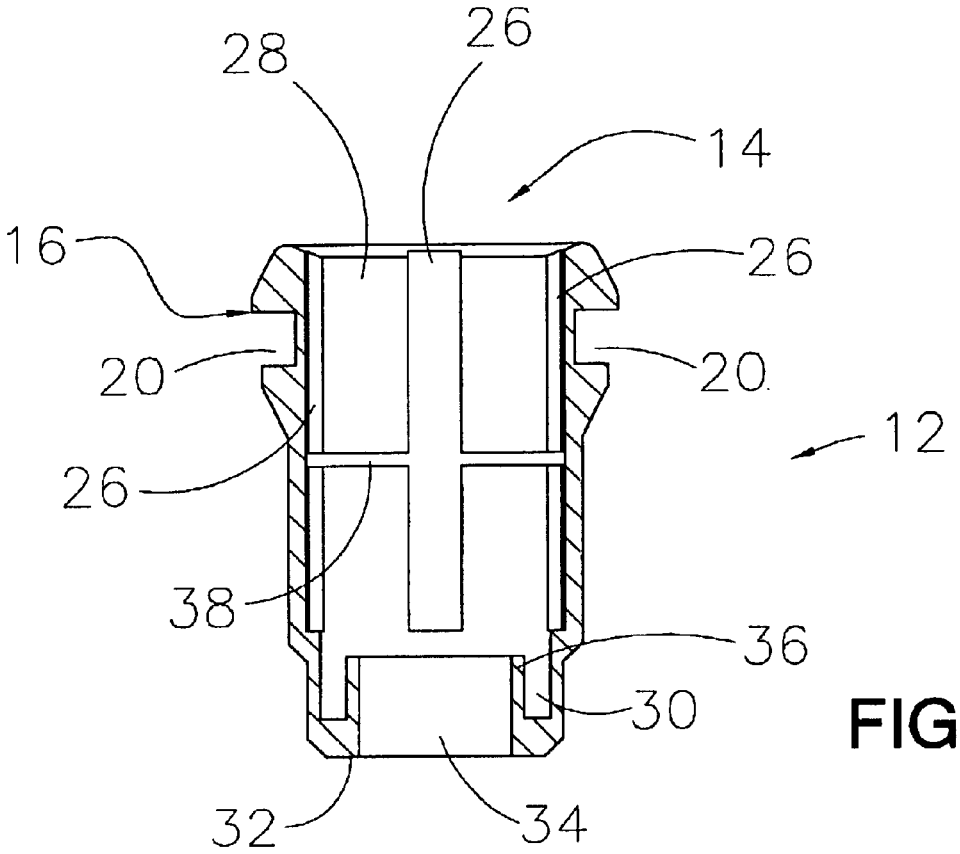
FIG. 3 is a cross-sectional view of the housing of FIG. 2 along view lines 3—3.

Turning to FIGS. 2 and 3, a top view of main housing 12 and a cross sectional view of main housing 12 are shown. Parallel engagement slots 26 are formed into sidewalls 28 of aperture 14. A cylindrical relief 30 is formed near a bottom of the distal end 32 housing, and is divided from a plunger opening 34 by a dividing wall 36. A spring clip recess 38 is formed around sidewalls 28 of aperture perpendicular to engagement slots 26.

Referring back to FIGS. 1 to 3, a ball retainer spring 50 is placed through aperture 14 and sits with springs lower end within cylindrical relief 30. A plunger button 52 having an outer diameter sized to slideably move through plunger opening 34 is provided. A plunger shaft 54 is affixed to plunger bottom 52, and plunger shaft 54 has a plunger lock structure, such as a plunger rim 56 extending from plunger shaft side walls 58 and is formed near an upper end 60 of plunger shaft. Although a rim is shown, other structures, such as indents, pockets, and the like, adapted to receive the balls or other movable stoppers can be provided so that the balls can lock against the plunger shaft and prevent plunger shaft from moving relative to the ball retainer. A plunger spring 62 rides around plunger shaft. A ball (or moveable stopper) retainer 70 (hereinafter referred to as "ball retainer") is provided and has a plunger opening 72 formed through a middle thereof. Ball retainer 70 has a generally cylindrical outer shape 74 with sliders 76 extending therefrom. Ball retainer 70 is sized so that cylindrical outer shape 74 slide in aperture 14 and sliders 76 are slideably received in engagement slots 26. A plunger washer 66 is placed below a bottom surface 78 of ball retainer 70 and provides a surface on which plunger spring 62 and ball retainer spring 50 can ride.

Figure 4:
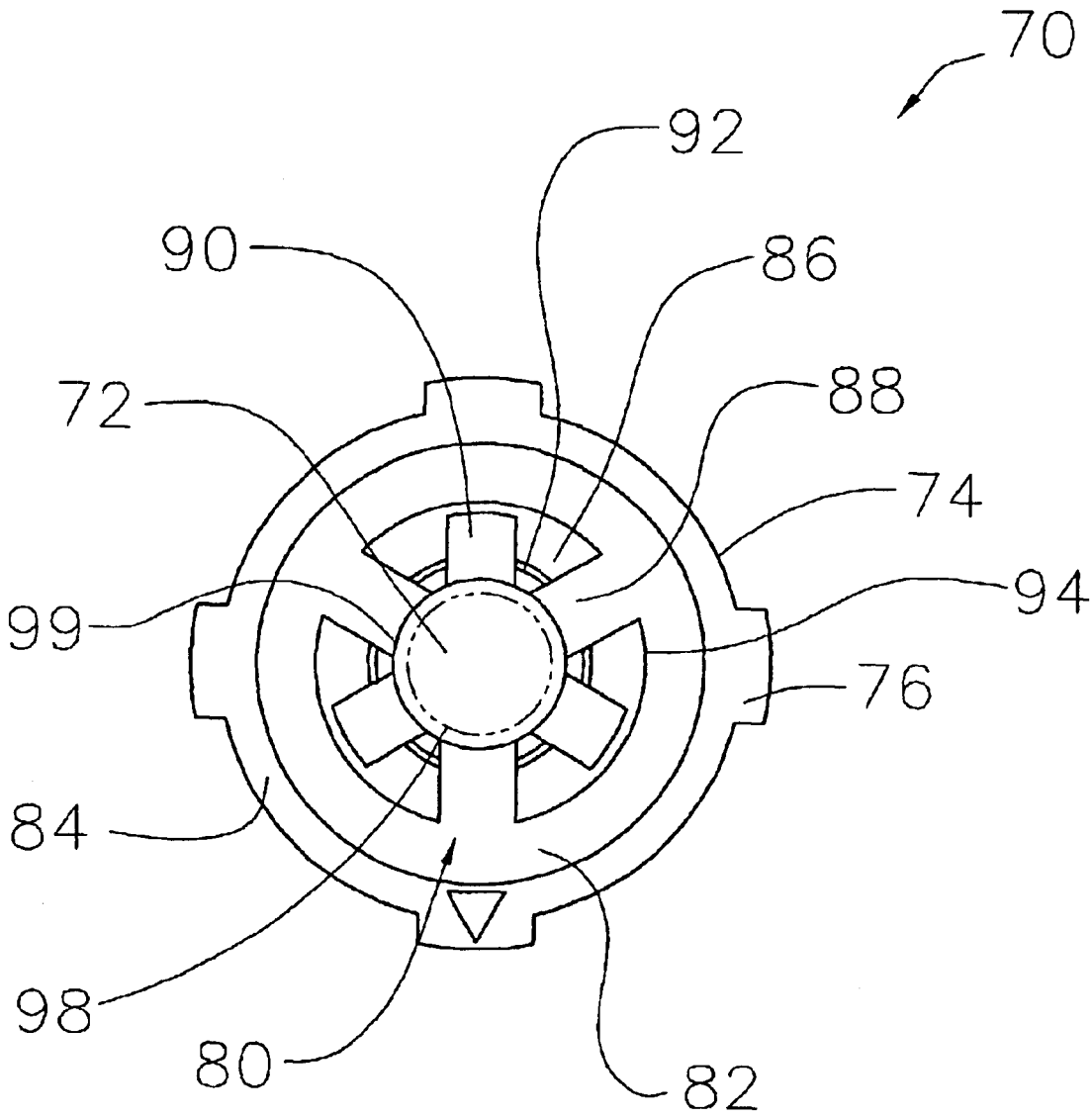
FIG. 4 is a top plan view of an upper face of the ball retainer of push button lock of the invention.

As best shown in FIG. 4, on an upper face 80 of ball retainer 70 an axial cylindrical channel 82 is formed inwardly of outer wall 84. Axial cylindrical channel 80 has a floor. Three ball (or moveable stopper) lobes 86 (hereinafter simply "ball lobes") extend upwardly from floor and are separated by three ball (or moveable stopper) channels 88 (hereinafter simply "ball channels".) Each ball lobe 86 has a notch 90 formed in a top 92 of ball lobe 86. Each ball lobe 86 has an outer perimeter wall 94 that preferably smoothly merges with top 92. Each ball channels 88 is sized to freely receive a ball (or other moveable stoppers) 96 therein (hereinafter simply "ball stopper"), which ball 96 is shown in FIG. 1. Plunger opening 72 extends to perimeter 99 with the plunger shaft walls 58 extending to dashed lines 98, and with plunger rim 56 extending to perimeter 99. When balls 96 are pushed against plunger shaft walls 58 (see FIG. 17), plunger shaft 54 cannot be pushed upwardly through plunger opening 72.

Referring to FIGS. 1 and 3, a spring clip 108 is provided. Ball retainer spring 50 is retained in cylindrical relief 30 (see FIG. 3). Plunger shaft 54 is inserted through plunger opening 72 of ball retainer 70. Distal end 110 of plunger shaft is engaged with plunger button 52. Plunger spring 62 is interposed on plunger shaft 54 between plunger button 52 and ball retainer 70 and a plunger washer 66 placed on the bottom 78 of ball retainer 70. Plunger spring 62 will tend to bias plunger shaft and its attached plunger button 52 away from ball retainer 70 and will provide a biasing force on plunger button 52 that extends through plunger opening 34 in housing. Ball retainer spring 50 will be placed in housing such that its lower end is placed in cylindrical relief 30 of housing and its upper end provides a biasing force on plunger washer 66 and thereby tends to bias ball retainer 70 upwardly. Spring clip 108 is snapped into spring clip recesses 38 with ball retainer 70 located in housing therebelow and under spring tension. Spring clip 108 blocks engagement slots 26 so as to prevent sliders 76 on ball retainer 70 from moving upwardly beyond spring clip recess 38 with spring clip 108 engaged therewith. However, by pressing down on ball retainer 70, it can be moved downwardly. An actuator spring 112 is placed in housing aperture 14 and sits atop outer wall 84 of ball retainer 70. An actuator 116 is placed within housing aperture 14 inside of the space of actuator spring 112.

Figure 5:
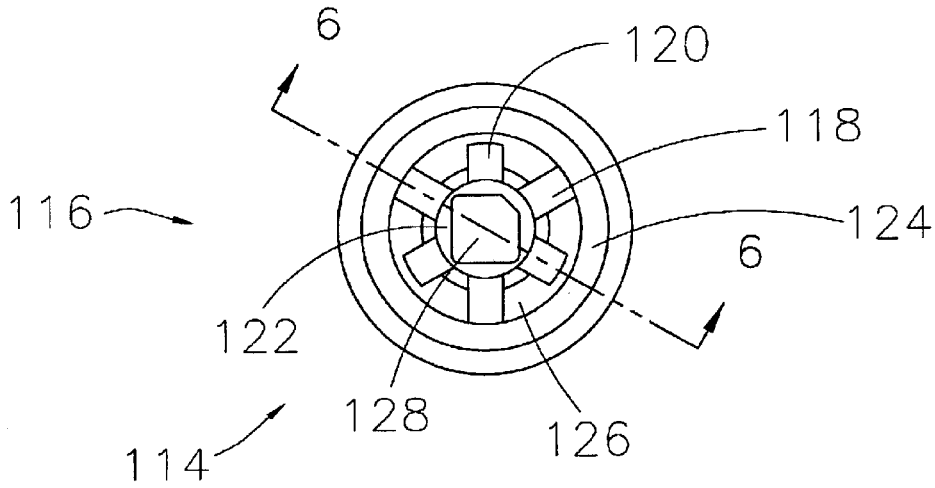
FIG. 5 is a bottom plan view of the actuator.

Turning to FIG. 5, a bottom plan view of bottom end 114 of actuator 116 is shown. Bottom end 114 of actuator 116 has a set of ramps 118 and blocks 120 spaced apart around a plunger bore 122. Plunger bore 122 is sized to permit plunger shaft to freely pass therethrough. Ramps 118 slope upwardly from plunger bore 122 to cylindrical sidewall 124. Blocks 120 can have a generally flat top surface. A lower region 126 of cylindrical sidewall 124 slopes downwardly and inwardly towards plunger bore 122. Blocks 120 are sized to be capable of being received within notch 90 of ball retainer 70. Ramps 118 are sloped and designed to ride on top of ball lobes. At an upper region of plunger bore 122, an out of round cutout 128 is provided. For ease of assembly, cutout 128 can be adapted to only have one possible insertion profile, such as shown with a square with a notched corner.

Figure 6:
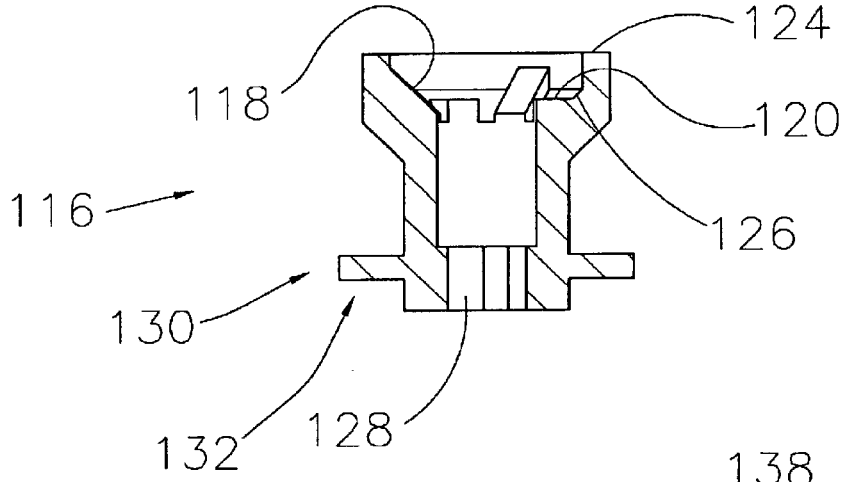
FIG. 6 is a cross-sectional view of actuator along view lines 6—6 of FIG. 5.

Turning to FIG. 6, there is shown a cross-sectional view of actuator 116 along view lines 6—6 of FIG. 5. A collar 130 extends outwardly from actuator 116 near its top portion 132.

Turning back to FIG. 1, a lock housing 140 is provided, into which a lock cylinder 142 is positioned. A lock housing scalp 144 can be used to secure lock cylinder 142 within lock housing 140. Lock housing has a generally cylindrical shape, but has housing protrusions 146 extending from a rim 148 extending from sides, which housing protrusions 146 are sized to slide within engagement slots 26 of housing aperture 14 to permit lock housing 140 to axially slide but not rotate therein. When assembled, lock housing 140, lock cylinder 142 and lock housing scalp 144 form a push button 138.

Figure 7:
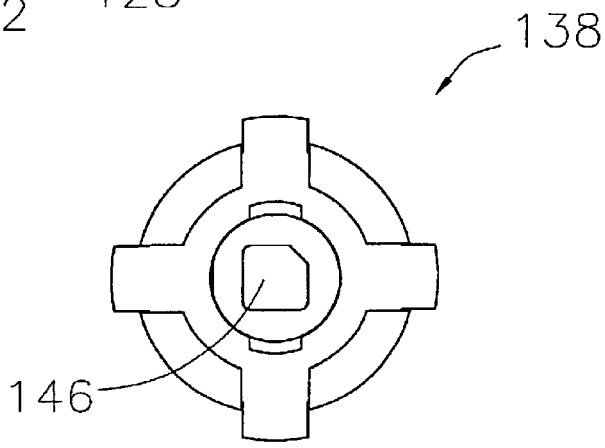
FIG. 7 is a bottom plan view of lock housing.

FIG. 7 is a bottom plan view of push button 138 and shows a lock cylinder protrusion 146 which is sized and shaped to engage with out of round cutout 128 of actuator.

Turning back to FIG. 1, an O-ring 152 is placed on lock housing scalp 144 and rides on rim 148. A housing scalp 154 can be used to retain lock housing in place, as well as all other components of the push button lock together.

Figure 8:
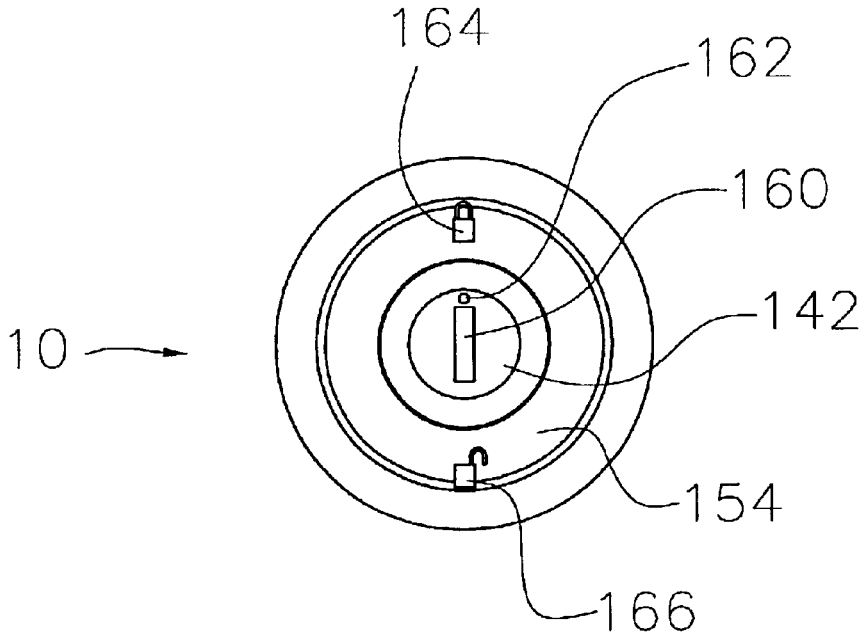
FIG. 8 is a top plan view of the assembled push button lock 10 in the locked position.

FIG. 8 is a top plan view of the assembled push button lock 10 in the locked position. Lock cylinder 142 has a key slot 160 with an indicator mark 162. A locked icon 164 and unlocked icon 166 can be placed on housing scalp 154, and by aligning key slot 160, a user can visually detect if push button lock 10 is locked or unlocked.

Figure 9:
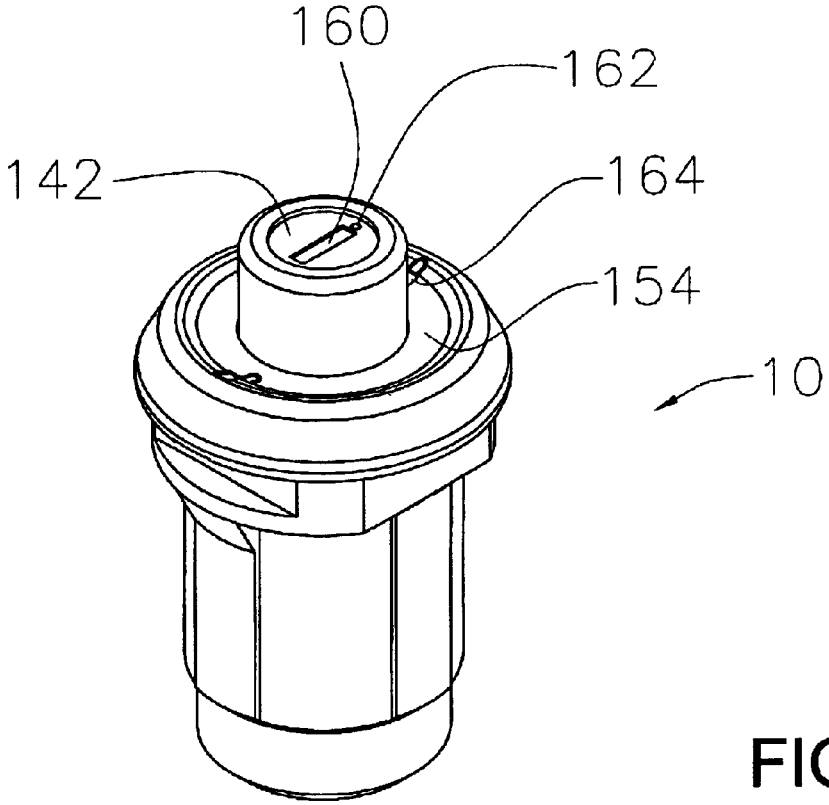
FIG. 9 is a perspective view of the assembled push button lock in the locked position.

FIG. 9 is a perspective view of the assembled push button lock 10 in the locked position.

Figure 10:
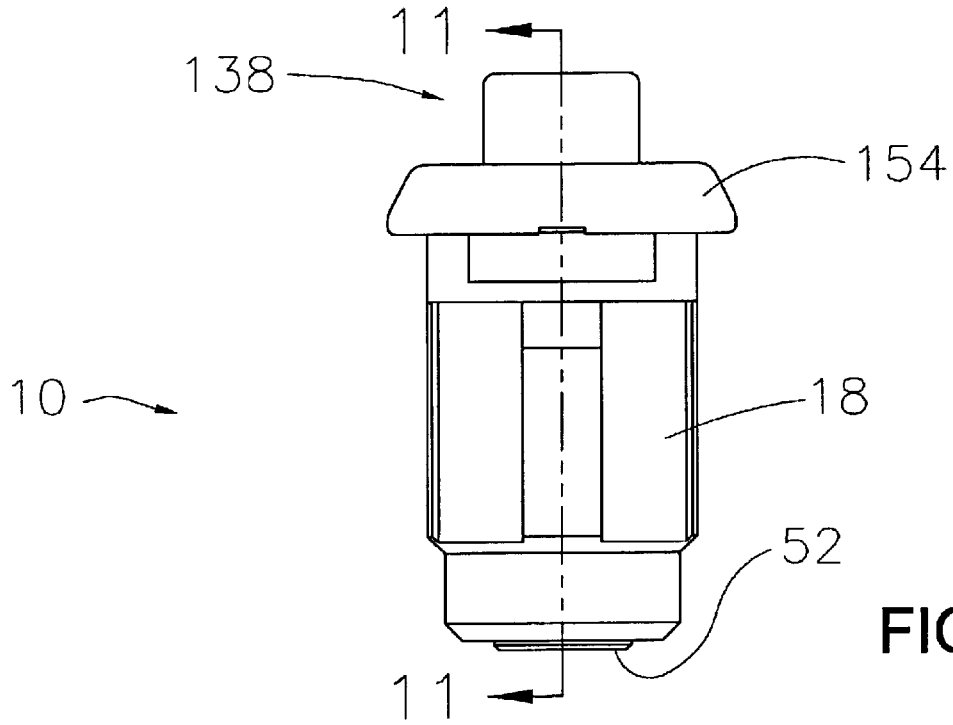
FIG. 10 is a side view of the assembled push button lock in the locked position.

FIG. 10 is side view of the assembled push button lock 10 in the locked position.

Figure 11:
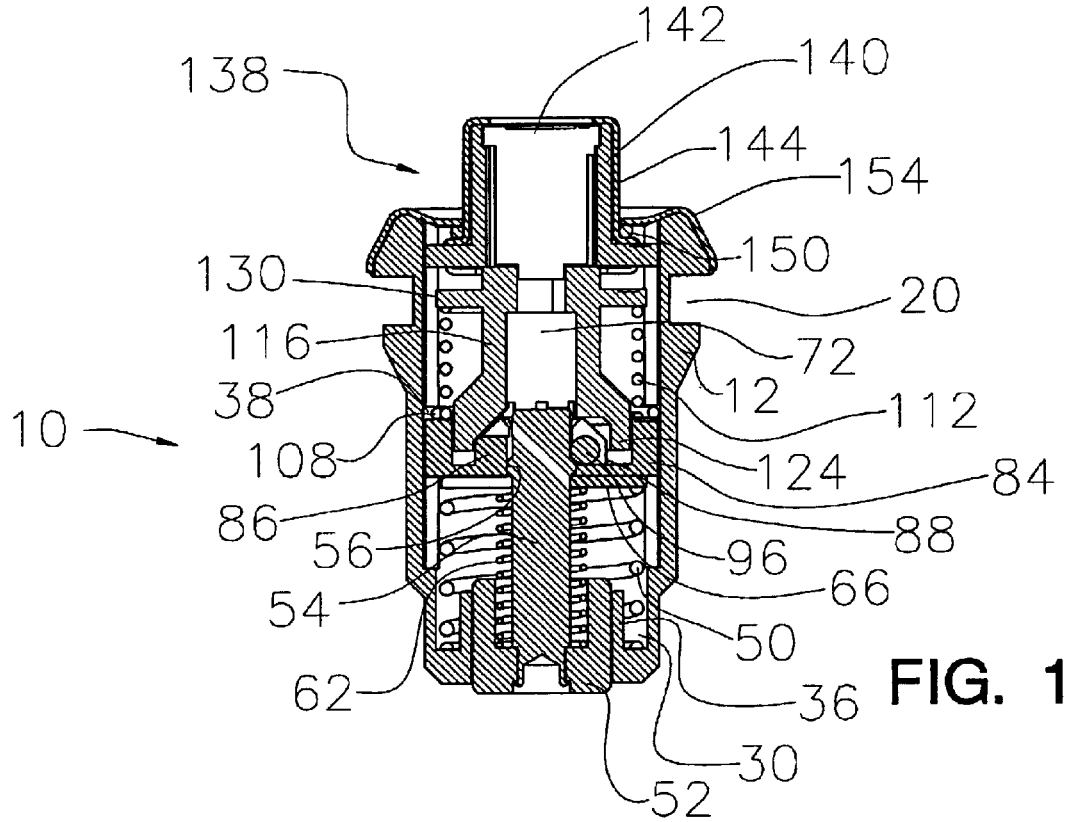
FIG. 11 is a cross-sectional view of the assembled push button lock in the locked position along view lines 11—11 of FIG. 10.

FIG. 11 is a cross-sectional view of the assembled push button lock 10 in the locked position along view lines 11—11 of FIG. 10. In the locked position, balls 96 are in ball channels 88 between ball lobes 86, and actuator 116 is turned in an orientation such that its ramps 118 are oriented over areas of ball retainer 70 other than ball channels 88. In this position, balls 96 can move outwardly away from plunger shaft walls 58 and plunger rim 56, thereby permitting plunger button 52 and its attached plunger shaft 54 to be moved upwardly relative to plunger bore 122 so that even if push button 138 is pushed down, plunger button 52 and its attached plunger shaft 54 are not pushed outwardly from housing 12.

Figure 12:
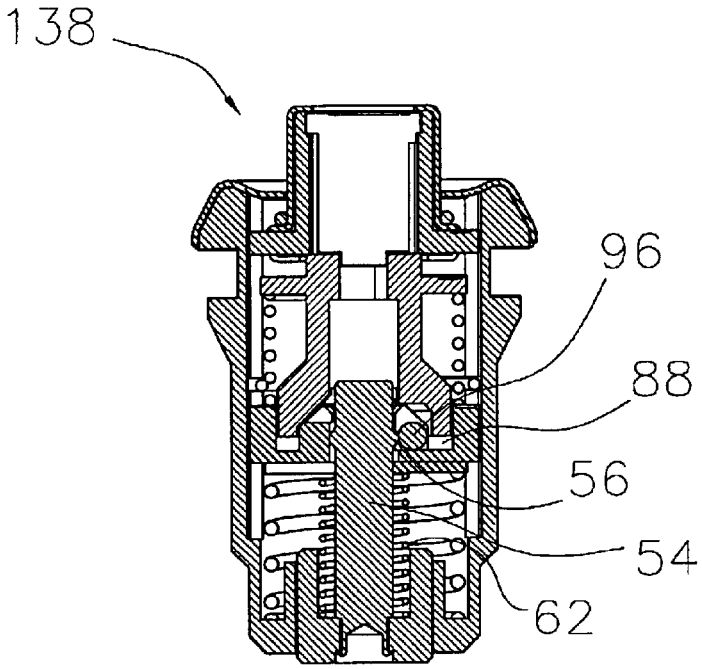
FIG. 12 is another cross-sectional view of the assembled push button lock, but with the push button 138 pushed in slightly.

FIG. 12 is another cross-sectional view of the assembled push button lock 10, but with the push button 138 pushed in slightly. As can be seen, pushing button down pushes actuator down onto plunger shaft 54 and plunger rim 56 is permitted to freely push ball 96 outwardly into ball channel 88.

Figure 13:
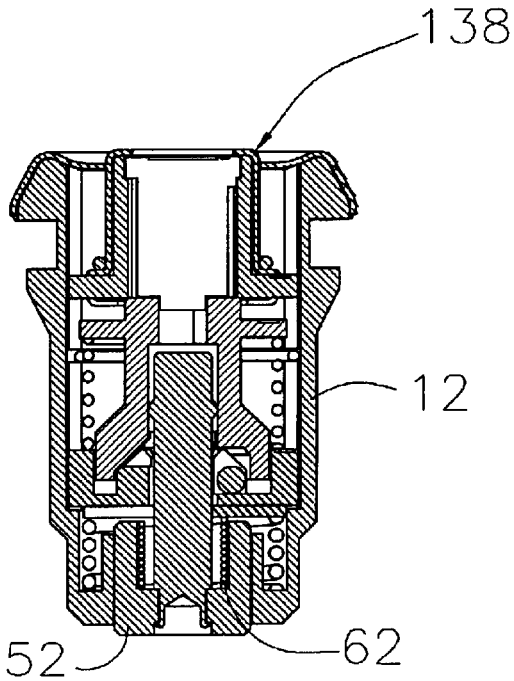
FIG. 13 is another cross-sectional view of the assembled push button lock, but with the push button pushed in completely.

FIG. 13 is another cross-sectional view of the assembled push button lock 10, but with the push button 138 pushed in all the way. Doing so compresses both plunger spring 62 and ball retainer spring 50. The spring tensions of plunger spring 62 and ball retainer spring 50 are selected so that plunger spring 62 has less spring force than that of ball retainer spring 50. Therefore, even if plunger spring 62 is fully compressed, it may not exert much force to push plunger button 52 out of housing 12.

Figure 14:
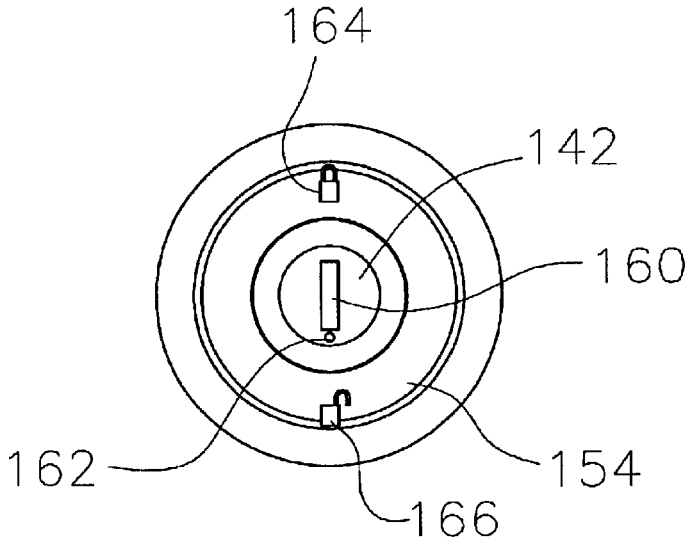
FIG. 14 is a top plan view of the assembled push button lock in the unlocked position.

FIG. 14 is a top plan view of the assembled push button lock 10 in the unlocked position, with indicator mark 162 of key slot 160 oriented to unlocked marking 166.

Figure 15:
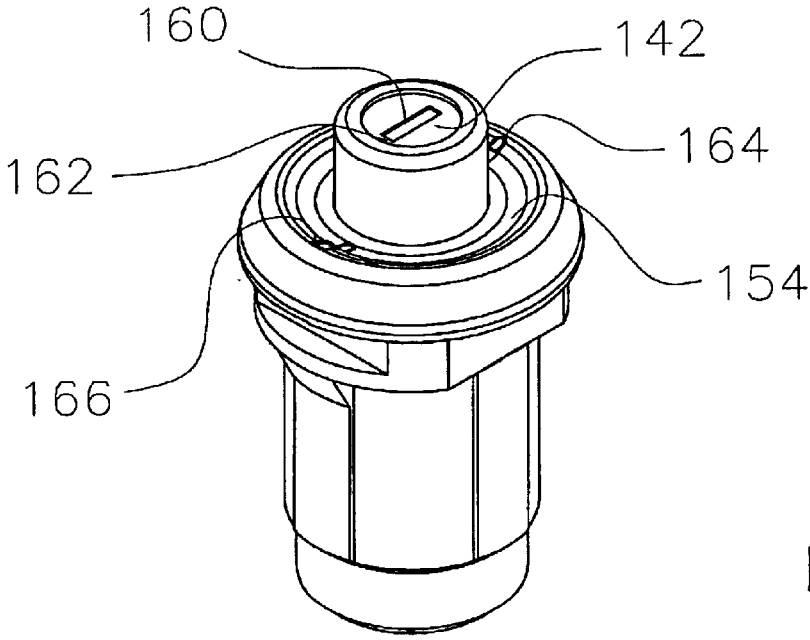
FIG. 15 is a perspective view of the assembled push button lock in the unlocked position.

FIG. 15 is a perspective view of the assembled push button lock 10 in the unlocked position.

Figure 16:
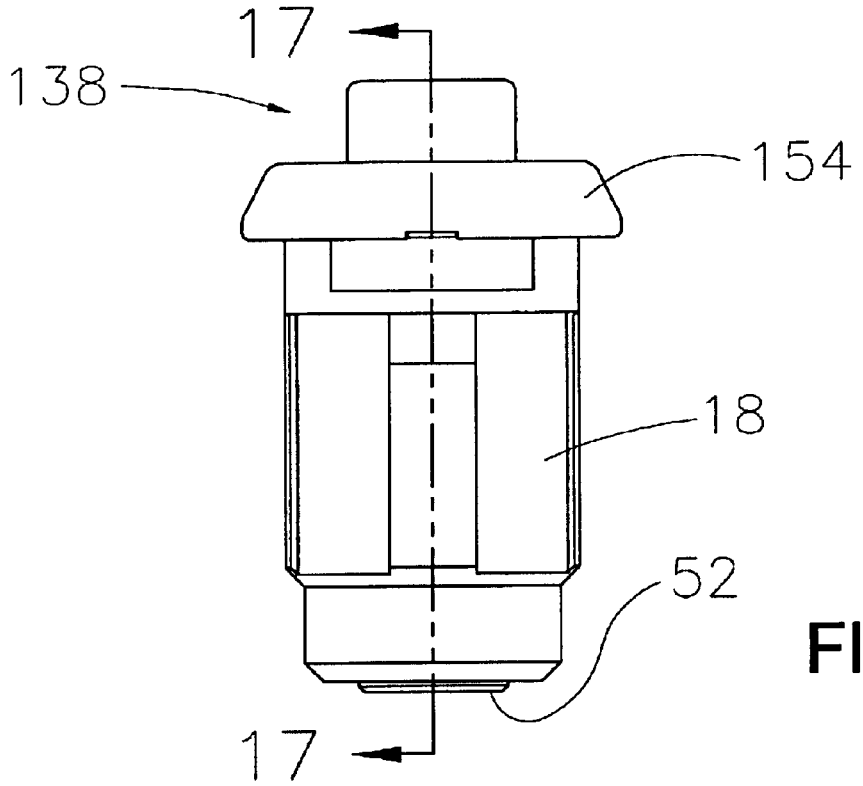
FIG. 16 is a side view of the assembled push button lock in the unlocked position.

FIG. 16 is a side view of the assembled push button lock 10 in the unlocked position.

Figure 17:
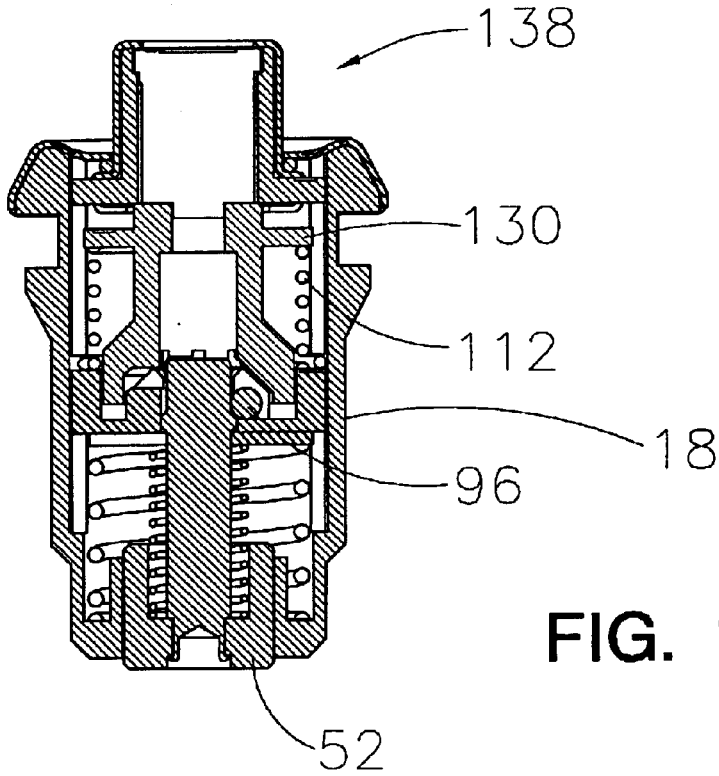
FIG. 17 is a cross-sectional view of the assembled push button lock in the unlocked position along view lines 17—17 of FIG. 16.
Figure 18:
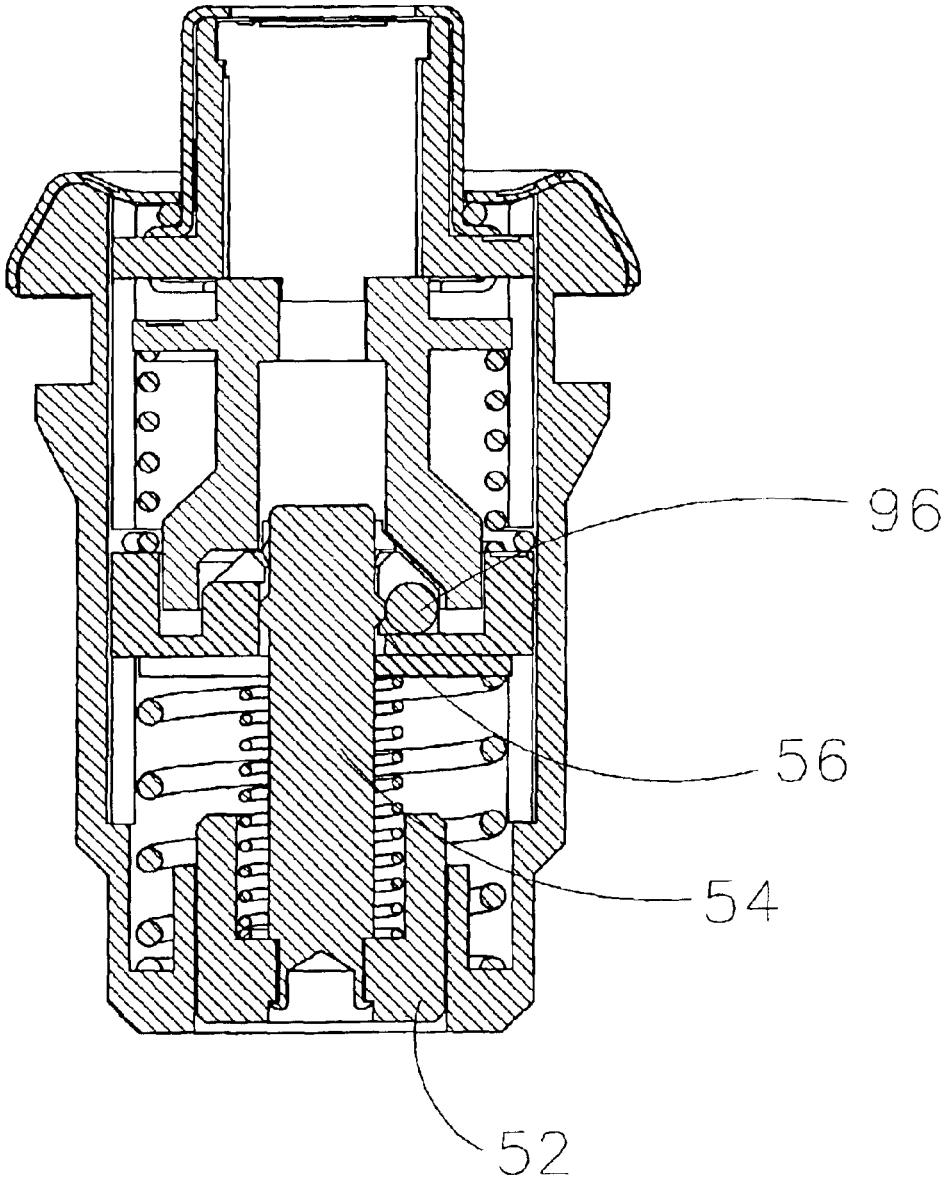
FIGS. 18 and 19 are cross-sectional views of the assembled push button lock in the unlocked position along view lines 17—17 of FIG. 16 but with plunger button being pushed into the housing.
Figure 19:
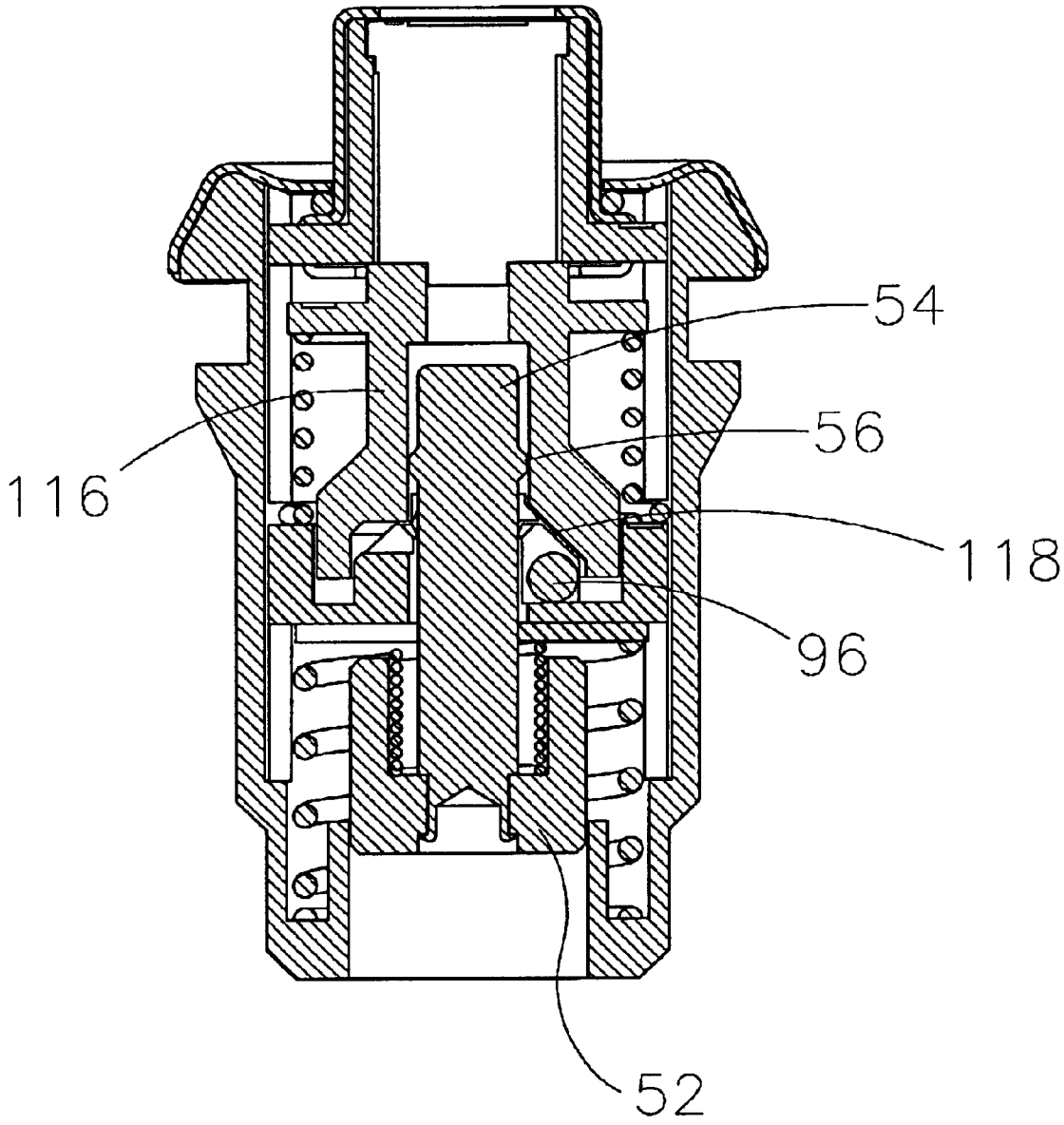

FIG. 17 is a cross-sectional view of the assembled push 15 button lock 10 in the unlocked position along view lines 17—17 of FIG. 16. In the unlocked position, balls 96 are in ball channels 88 between ball lobes 86, and actuator 116 is turned in an orientation such that its ramps 118 are oriented directly over notches 90 of ball retainer 70. However, due to the force of actuator spring 112 on collar 130 of actuator, ramps 118 are still not seated into notches 90 of ball retainer 70, and plunger button 52 can be pushed inwardly so that plunger shaft 54 will be allowed to move into plunger opening 72 since balls 96 will not impinge on plunger rim 56 and prevent this movement, as shown in FIGS. 18 and 19.

Figure 20:
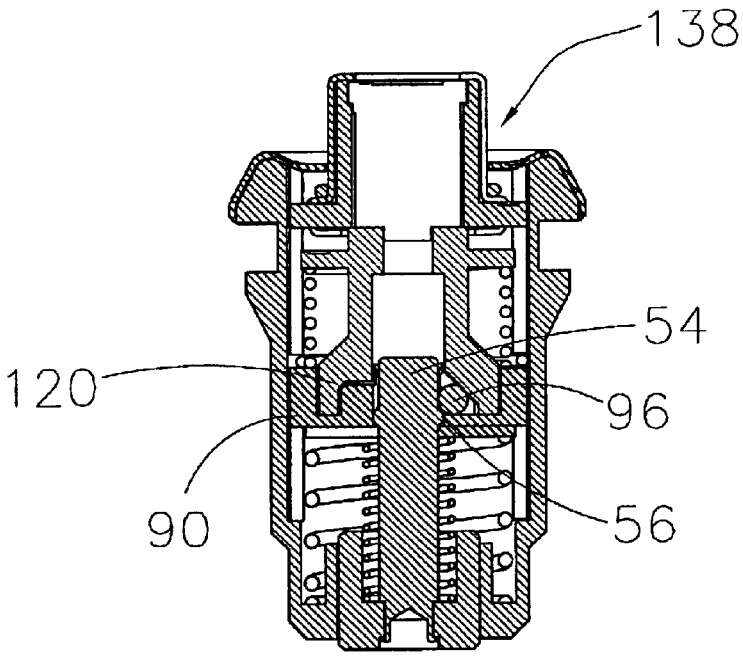
FIG. 20 is a cross-sectional view of the assembled push button lock in the unlocked position along view lines 17—17 of FIG. 16, but with push button first depressed.

Turning next to FIG. 20, when push button 138 is first depressed, actuator 116 will move downwardly so that its blocks 120 will seat within notches 90 of ball retainer 70. In this position, ramps 118 of actuator bear on balls 96 and prevent balls from moving away from plunger shaft 54. Thus, plunger shaft 54 cannot move upwardly since its plunger rim 56 cannot pass by balls 96.

Figure 21:
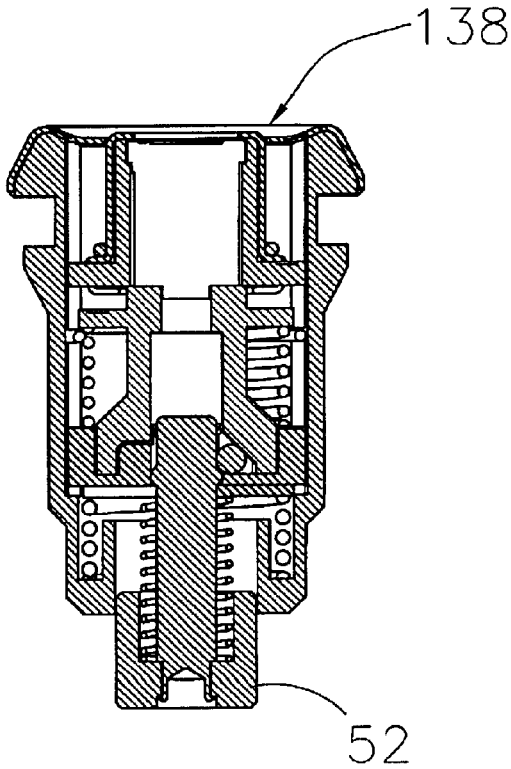
FIG. 21 shows push button pushed down completely into housing.

FIG. 21 shows push button 138 pushed down completely into housing, with plunger button 52 pushed out of housing. In this operation, ramps 118 of actuator bear on balls 96 and prevent balls from moving away from plunger shaft 54. Accordingly, the force pushes plunger shaft down.

Although the invention has been described with respect to balls, other moveable stoppers could be used instead. Moreover, while the invention is shown with three balls, three ball lobes, three ball channels, etc., a greater number could be used. However, an odd number of balls (such as three) equally spaced around the ball retainer provides an advantage in that a half turn of the lock will move the actuator between its locked and unlocked states.

The lock housing is described as having slots formed on the inside walls of its aperture and the moveable stopper retainer and lock housing are described as having protrusions which are sized to be slideably received in the slots so as to prevent rotation of these parts in lock housing. However, it is possible to exchange the position of these features so that the protrusions are formed on the inside wall of the aperture and slots are formed on the moveable stopper retainer and lock housing. Moreover, it is possible to provide a single slot and protrusion as well, the point being to stop any turning of the parts relative to each other so that the action of turning the lock cylinder will rotate the actuator relative to the moveable stopper retainer. In this respect, these feature can be termed "anti-rotation means".

The drawings show the plunger shaft as having a plunger rim. The plunger rim prevents the plunger from being pulled completely through the ball retainer and acts as a stop for the balls. However, it is possible provide a locking effect of the balls against the plunger by, for example, having pockets, detents, recesses, etc., formed on the plunger shaft into which the balls will be received when the push button lock is in the unlocked position with the lock button pushed.

The present invention covers the modifications and variations of this invention provided they come within the scope of the appended claims and their equivalents. In this context, equivalents means each and every implementation for carrying out the functions recited in the claims, even those not explicitly described herein.

What is claimed is:

1. A push button lock, comprising:

a main housing with an aperture formed therethrough;

a plunger which is axially moveable in the aperture of the main housing;

a moveable stopper retainer positioned in the aperture of the main housing, the moveable stopper retainer having a central aperture formed therein through which the plunger extends, and a protrusion formed thereon;

at least one moveable stopper placed on the moveable stopper retainer;

an actuator located in the main housing aperture above the moveable stopper retainer and rotatable to an opened position, wherein the actuator can be pushed down to push the at least one moveable stopper against the plunger shaft and thereby prevent the plunger shaft from moving relative to the moveable stopper retainer, and a locked position, wherein the at least one moveable stopper is not retained against the plunger shaft and the plunger shaft can move relative to the moveable stopper retainer; and a lock button having a lock housing and a lock cylinder, the lock cylinder being adapted to turn the actuator from the opened position to the locked position, and the lock button being pushable into the main housing.

2. The push button lock of claim 1, further comprising a biasing means for biasing the actuator away from the moveable stopper retainer so that when the lock button is depressed when in the unlocked or unlocked position, the plunger will not be capable of being moved into the main housing.

3. The push button lock of claim 1, further comprising biasing means for providing spring loading of the plunger relative to the moveable stopper retainer.

4. The push button lock of claim 1, further comprising biasing means for providing spring loading of the moveable stopper retainer relative to the lock housing.

5. The push button lock of claim 1, further comprising anti-rotation means to prevent rotation of the lock housing and moveable stopper retainer relative to the main housing.

6. The push button lock of claim 1, wherein the moveable stopper comprises at least one ball.

7. The push button lock of claim 1, wherein the protrusion on the moveable stopper comprises at least one moveable stopper lobe with a notch formed thereon and the actuator has at least one block formed thereon which is sized to be seatable with the notch when in the opened position, and the actuator has at least one ramp formed thereon which will impinge on the moveable stopper lobe when in the locked position.

8. The push button lock of claim 1, further comprising a plunger button fixed to a distal end of the plunger.

9. The push button lock of claim 1, wherein the plunger has a plunger rim against which the at least one moveable stopper may impinge when the actuator is in the opened position and the lock button is pushed into the main housing.

10. The push button lock of claim 1, wherein the lock cylinder is a key lock.

11. The push button lock of claim 1, wherein the plunger shaft further comprises a plunger rim extending outwardly from the plunger shaft.

12. A push button lock, comprising:

a main housing with an aperture formed therethrough;

a plunger which is axially moveable in the aperture of the main housing;

a moveable stopper retainer positioned in the aperture of the main housing, the moveable stopper retainer having a central aperture formed therein through which the plunger extends, and a protrusion formed thereon;

a plunger spring for biasing the plunger away from the moveable stopper retainer;

at least one moveable stopper placed on the moveable stopper retainer;

an actuator located in the main housing aperture above the moveable stopper retainer and rotatable to an open position, wherein the actuator is in position to be pushed down to prevent the at least one moveable stopper from moving away from the plunger shaft and thereby prevent the plunger shaft from moving relative to the moveable stopper retainer, and a locked position, wherein the at least one moveable stopper is not retained against the plunger shaft and the plunger shaft can move relative to the moveable stopper retainer;

a lock button having a lock housing and a lock cylinder, the lock cylinder being adapted to turn the actuator from the opened position to the locked position;

a moveable stopper retainer spring for biasing the moveable stopper retainer towards the lock button; and an actuator spring for biasing the actuator away from the moveable stopper retainer so that when the lock button is depressed in the locked or unlocked position, the plunger will not be capable of being pushed into main housing.

13. The push button lock of claim 12, further comprising anti-rotation means to prevent rotation of the lock housing and moveable stopper retainer relative to the main housing.

14. The push button lock of claim 12, wherein the moveable stopper comprises a ball.

15. The push button lock of claim 12, wherein the at least one moveable stopper lobe has a notch formed thereon and the actuator has at least one block formed thereon which is sized to be seatable with the notch when in the open position and with the lock button pushed to thereby force the moveable stopper into contact with the plunger, and the actuator has at least one ramp formed thereon which will impinge on the moveable stopper lobe when in the opened position to permit the moveable stopper to move away from the plunger even when the lock button is pushed.

16. The push button lock of claim 12, further comprising a plunger button fixed to the distal end of the plunger.

17. The push button lock of claim 12, wherein the lock cylinder is a key lock.

18. The push button lock of claim 12, wherein the plunger shaft further comprises a plunger rim extending outwardly from the plunger shaft.

19. A push button lock, comprising:

a main housing with an aperture formed therethrough;

a plunger which is axially moveable in the aperture of the main housing and having a lock structure formed thereon;

a ball retainer positioned in the main housing aperture and having a central aperture formed therein through which the plunger extends, and a protrusion formed on the moveable stopper retainer;

a plunger spring for biasing the plunger away from the moveable stopper retainer;

at least one ball placed on the ball retainer, the ball being adapted to seat against the lock structure on the plunger;

an actuator located in the main housing aperture above the ball retainer and rotatable to an open position wherein the actuator is in position to be pushed down to prevent the at least one ball from moving away from the lock structure of the plunger shaft and thereby prevent the plunger shaft from moving relative to the ball retainer, and a locked position, wherein the at least one ball is not retained against the lock structure of the plunger shaft and the plunger shaft can move relative to the ball retainer;

a lock button having a lock housing and a lock cylinder, the lock cylinder being adapted to turn the actuator from the opened position to the locked position;

a ball retainer spring for biasing the ball retainer towards the lock button; and an actuator spring for biasing the actuator away from the ball retainer so that unless lock button is depressed in the unlocked position, the plunger will be capable of being pushed into main housing.

* * * * *